US006688807B2

(12) United States Patent
Navarrete

(10) Patent No.: US 6,688,807 B2
(45) Date of Patent: Feb. 10, 2004

(54) SEALING DEVICE FOR A MANHOLE

(75) Inventor: Maximino Martínez Navarrete, Valencia (ES)

(73) Assignee: Albemarna, S.L., Valencia (ES)

( * ) Notice: Subject to any disclaimer, the term of this patent is extended or adjusted under 35 U.S.C. 154(b) by 0 days.

(21) Appl. No.: 10/345,089

(22) Filed: Jan. 15, 2003

(65) Prior Publication Data

US 2003/0129027 A1 Jul. 10, 2003

Related U.S. Application Data

(63) Continuation of application No. PCT/ES01/00292, filed on Jul. 23, 2001.

(30) Foreign Application Priority Data

Jul. 24, 2000 (ES) ..... 200001976 U

(51) Int. Cl.[7] ..... E02D 29/14
(52) U.S. Cl. ..... 404/25; 52/20
(58) Field of Search ..... 404/25, 26; 52/19, 52/20

(56) References Cited

U.S. PATENT DOCUMENTS 4,461,597 A * 7/1984 Laurin ..... 404/25
4,648,740 A * 3/1987 Carlson ..... 404/25
4,763,449 A * 8/1988 Vigneron et al. ..... 52/20
4,772,154 A * 9/1988 Caroulle ..... 404/25
4,969,771 A * 11/1990 Bowman ..... 404/26
5,549,411 A * 8/1996 Hawkins ..... 404/25
6,161,984 A * 12/2000 Sinclair ..... 404/25

FOREIGN PATENT DOCUMENTS

EP 633362 A1 * 1/1995 ..... E02D/29/14

* cited by examiner

*Primary Examiner*—Robert E. Pezzuto
*Assistant Examiner*—Alexandra K. Pechhold
(74) *Attorney, Agent, or Firm*—Klauber & Jackson

(57) ABSTRACT

A sealing device that ensures the hermetic securing of the lid (5) in the access mouth (2) in order to prevent any infiltration of fluids from the outside or escape of gases from the interior.

The device comprises a frame (1), a lid (5) that rests on said frame (1) with interposition of a sealing joint (6), and a crosspiece (12) in order to facilitate the securing of the lid (5) with the aid of a screw (21). The sealing joint (6) permits complete imperviousness be obtained in the sealing of the device.

10 Claims, 5 Drawing Sheets

A-B

SEALING DEVICE FOR A MANHOLE

This is a continuation of PCT/ES01/00292 filed on Jul. 23, 2001.

OBJECT OF THE INVENTION

The invention consists of a sealing device for a manhole intended to provide an hermetic seal for the access mouth with the aid of a lid that forms part of the assembly of the device.

The sealing device ensures the securing of the lid in the access mouth in order to prevent any infiltration of fluids from the outside or escape of gases from the interior.

BACKGROUND OF THE INVENTION

Manholes currently include an access opening or mouth where a sealing lid is fitted in order to isolate the interior of the hole from the exterior in order to protect the contents of that hole.

The lid is normally associated with a sealing device that ensures the fastening of said lid in order to provide tightness and imperviousness in the seal so as to prevent any infiltration of fluids or gases from the outside to the interior.

Utility model No. 9800352 consists of a sealing device for underground tanks that includes a lid that fits into a frame provided in correspondence with the access mouth to the tank. This lid rests against a sealing O-ring housed in a perimetric groove in the frame. The sealing device basically consists of a crosspiece whose ends are associated with the frame, while at the same time a central screw threads onto this crosspiece in order to secure the lid against the O-ring, this latter being the element which, along with the lid, provides the tank with its imperviousness.

The device of utility model number 9800352 presents the drawback that, after a period of time, the imperviousness of the tank becomes reduced and the seal loses its effectiveness, mainly due to the weakness of the structure presented by the crosspiece where the securing screw threads into the lid, in such a way that, after a while, it becomes deformed and arches upwards, with which the pressure of the lid on the O-ring becomes reduced and the tank therefore loses its tightness.

Another drawback is that after a while, when the access lid is removed, the O-ring sticks to the lid, causing it to become dislodged from its position, which thereby creates the danger of the ring falling into the tank.

DESCRIPTION OF THE INVENTION

In order to achieve the objectives and to avoid the drawbacks mentioned in the above paragraphs, the sealing device for manholes is characterised in that it includes a new sealing joint with a profile that is clasped to at least a portion of the frame made in the mouth of the hole, a lid which will rest on said joint being secured on the frame. In this way, the joint will at all times remain on the frame without becoming detached from it when the lid is removed.

The device is also characterised in that the lower face of the lid includes a perimetric inclined band that in a complementary way makes contact against the sealing joint, thereby achieving a better seal.

Another improvement refers to the structure presented by the crosspiece wherein the screw is threaded for securing the lid. Unlike the crosspiece of the utility model mentioned in the previous section, this crosspiece does not arch when the screw is tightened, which means the imperviousness of the lid is not adversely affected.

Another characteristic of the invention consists of the means of linking the crosspiece on the frame of the access mouth to the interior of the hole. Thus, instead of the springs used in utility model No. 9800352, in the present invention a plurality of simple conventional mechanisms for quick locking and a plurality of lower stops are used, which substantially facilitate the extraction of the respective crosspiece. When the quick locking mechanisms are unlocked, the crosspiece rests on the lower stops.

Another improvement to the device refers to the fact that the frame includes means for preventing its deformation when the lid is secured and tightened.

In order to aid a better understanding of the invention, the description is accompanied by figures representing the object of the invention.

DESCRIPTION OF A PREFERRED EMBODIMENT OF THE INVENTION

Figure 1:
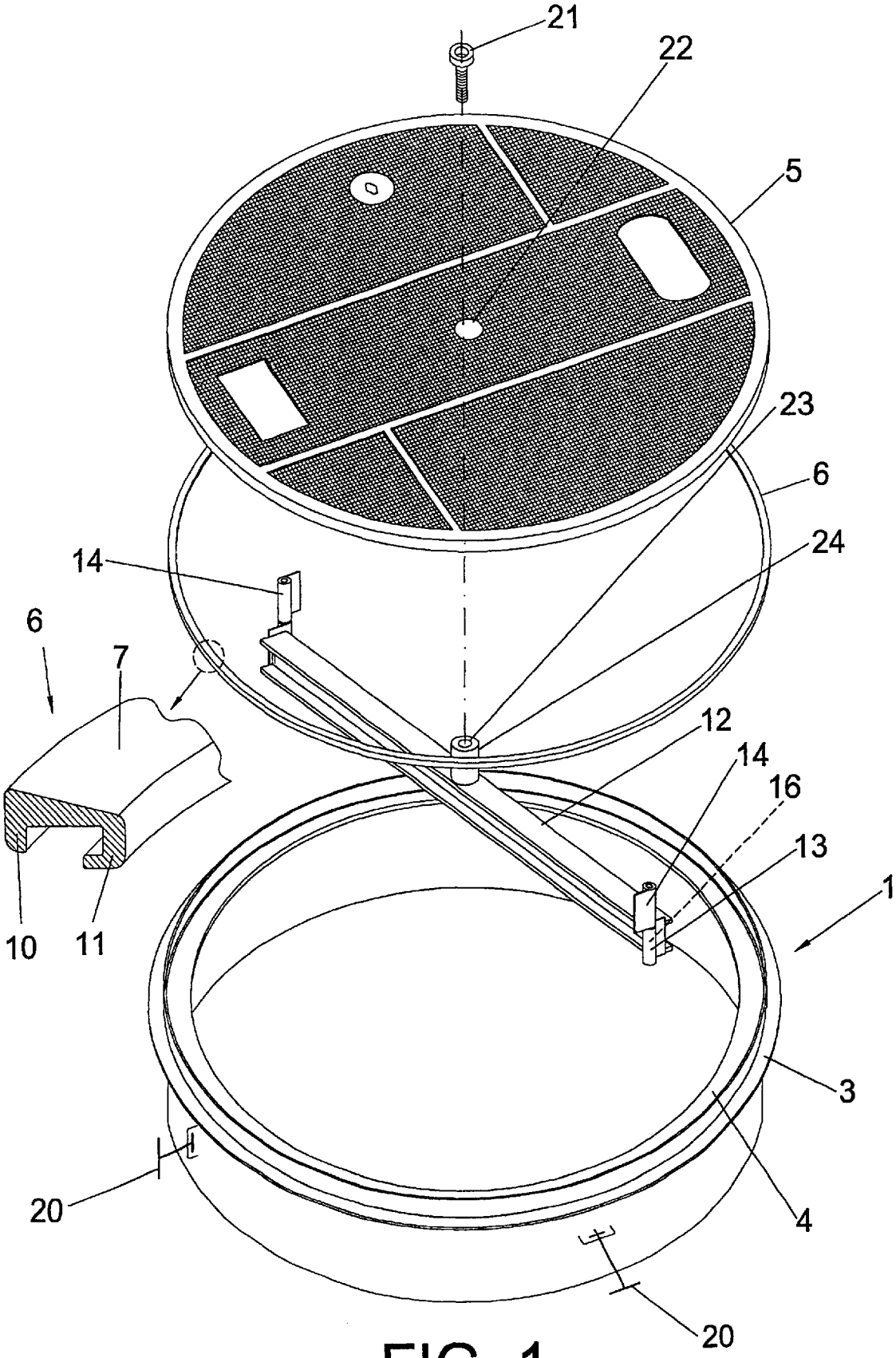
FIG. 1 represents an exploded perspective view of the sealing device assembly for the manhole, forming the object of the invention. It basically includes a frame, to which is coupled an access lid to the inside of the hole with the interposition of a sealing joint. It also includes at least one crosspiece associated with the frame and in which is secured the lid with the aid of a central screw.
Figure 2:
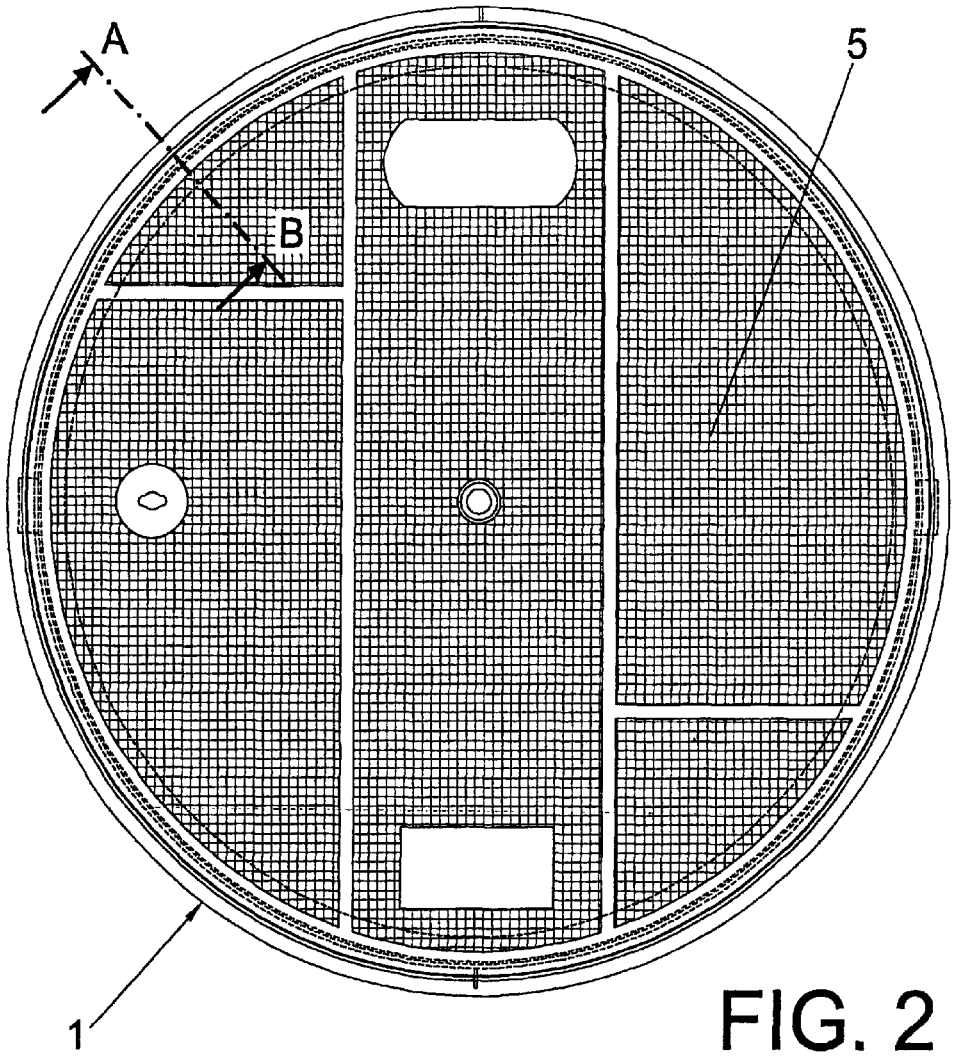
FIG. 2 represents a plan view of the device of the invention.
Figure 3:
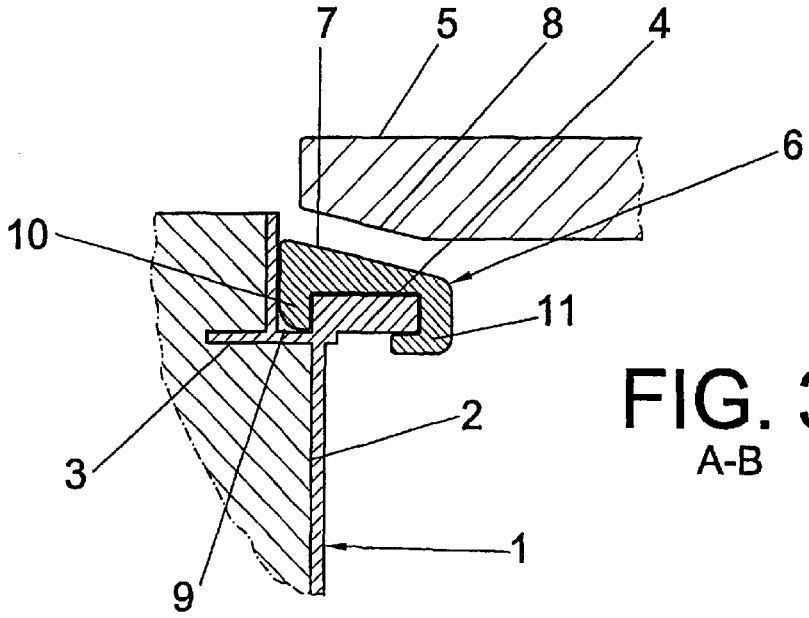
FIG. 3 represents a view in cross-section along line A-B of the previous figure.
Figure 4:
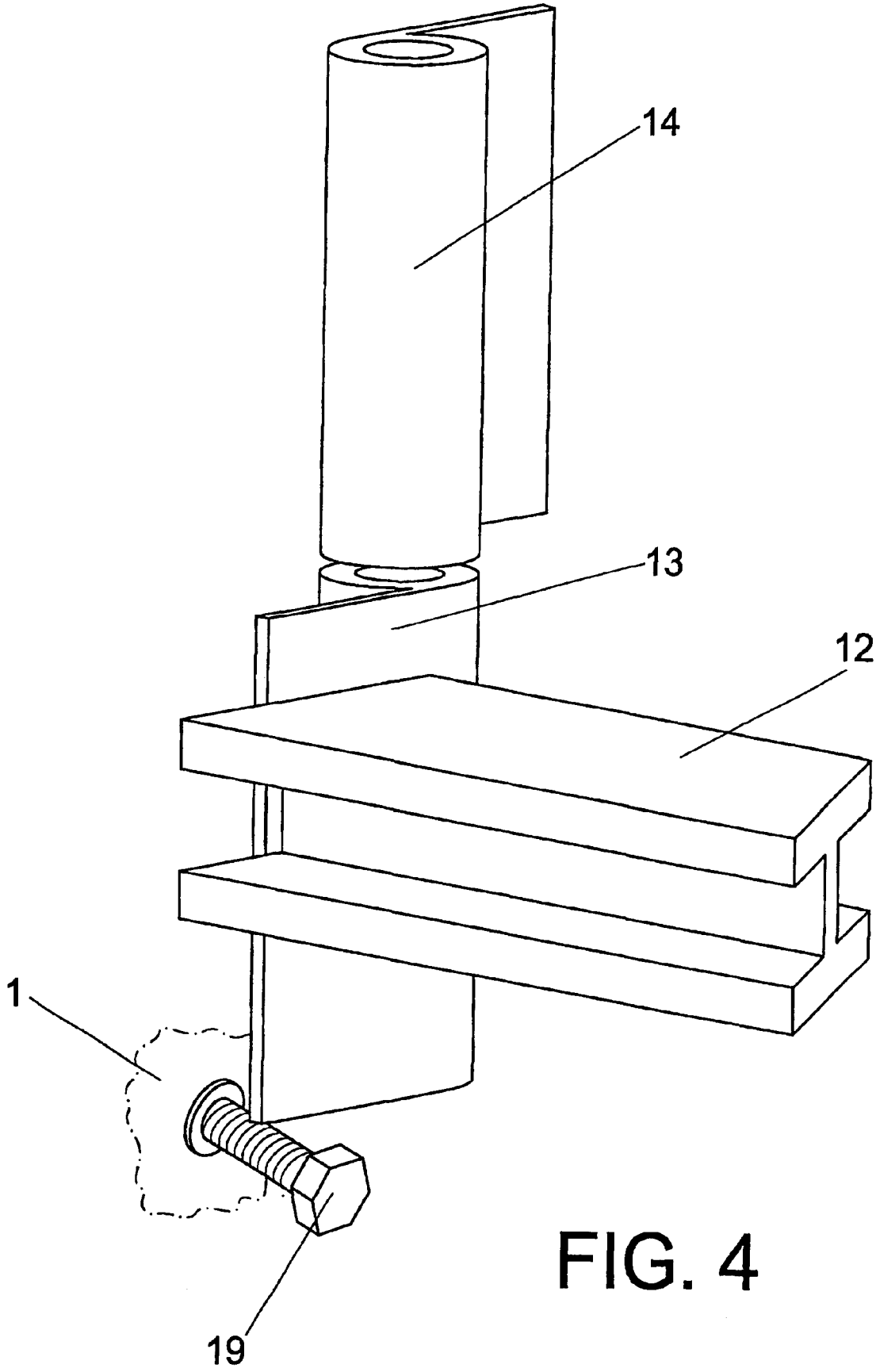
FIG. 4 represents a view of part of the device mainly showing some seating and retention stops for the crosspiece.
Figure 5:
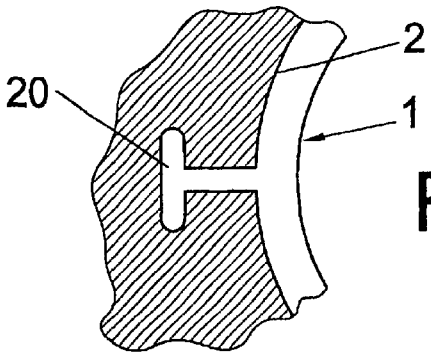
FIG. 5 shows a securing fastening f or the frame of the device of the invention.
Figure 6:
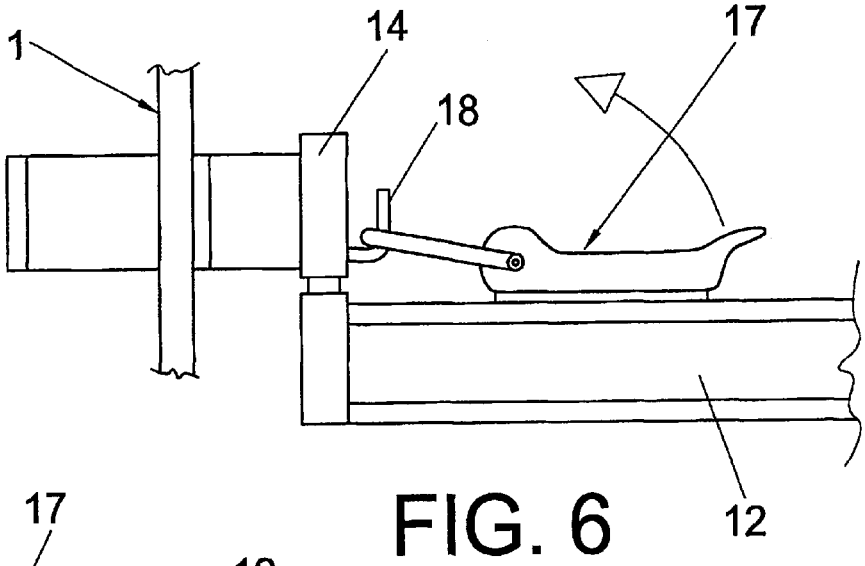
FIG. 6 essentially shows a mechanism for hooking the crosspiece to the frame.

An example of an embodiment of the invention following the numbering system adopted in the figures is described below.

The sealing device for the manhole is made on the basis of a frame 1 which is fixed on an access mouth or opening 2 made in correspondence with the ground.

The frame 1 includes an exterior rim 3 embedded beneath the ground and an interior rim 4 on which a sealing lid 5 rests with interposition of a sealing joint 6 which couples to and clasps the interior rim 4.

The joint 6 includes an upper inclined plane 7 on which the inclined plane of a lower perimetric band 8 of the lid 5 rests in a complementary fashion, in such a way that when the lid 5 is secured, a hermetic seal which is highly effective and progressive in line with the tightening of the lid against the joint 6, is achieved.

The interior rim 4 is provided with a channel 9 in which an exterior flange of the sealing joint 6 is housed. On the other hand, the internal end of the joint 6 ends in another bent section 11 that clasps the inside part of the internal rim 4 of the frame 1.

Figure 7:
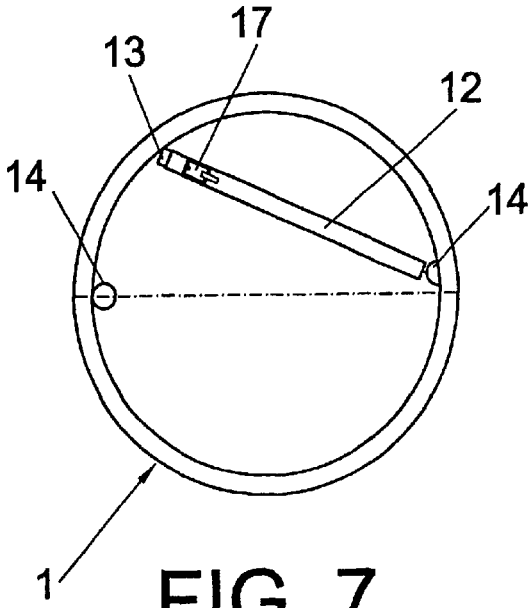
FIG. 7 shows a schematic plan view of the crosspiece linked to the frame by means of a vertical articulated coupling.

The securing of the lid 5 is done by means of at least one crosspiece 12 that is associated via its ends to the frame 1. In order to achieve this, the ends of said crosspiece 12 include a plurality of elongations 13 facing a plurality of upper pieces 14 made integral with the frame 1, in such a way that one of the elongations 13 of the crosspiece 12 is coupled in an articulated fashion to the frame 1, either by means of a horizontal axis 15 (FIG. 8) or by means of a vertical axis 16 (FIG. 7) which links one of the elongations 13 of the crosspiece 12 with the respective upper piece 14. On the contrary, the other end section of the crosspiece 12 includes a conventional fast locking mechanism 17 which hooks to a small bent extension 18 emerging from the other upper piece 14 integral with the frame 1.

Figure 8:
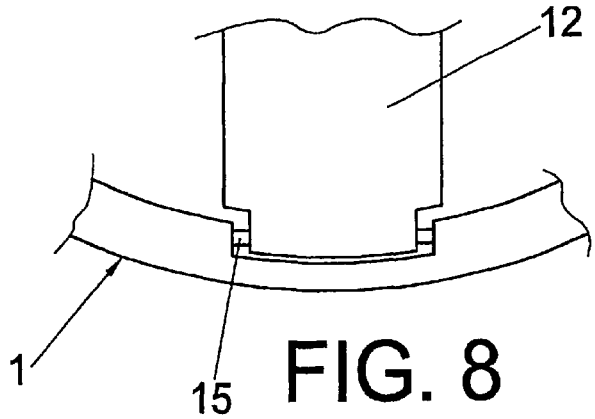
FIG. 8 shows a similar view to the previous one, where the crosspiece is linked to the frame by means of a horizontal articulated coupling.
Figure 9:
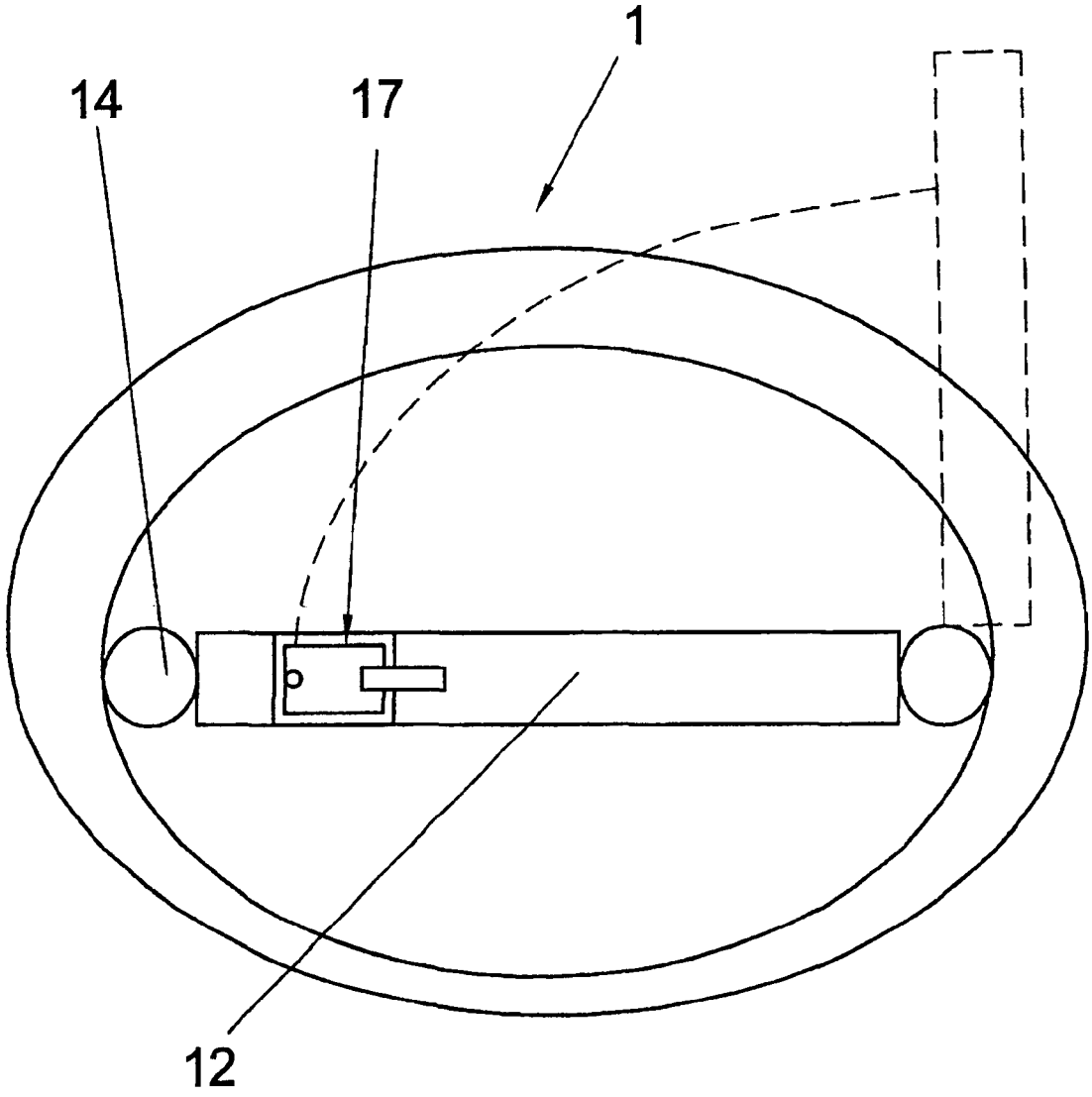
FIG. 9 shows a perspective view where the crosspiece is associated with the frame by means of a vertical articulated coupling that presents a different structure with respect to that represented in FIG. 7.

When it is necessary to gain access to the interior of the hole, once the hook mechanism 17 has been released, the crosspiece will be displaced to one side when the articulation of the crosspiece 12 is vertical (FIG. 7) or upwards when the articulation of the crosspiece 12 is horizontal (FIG. 8).

The framework 1 includes a plurality of stops 19 essentially determined by a plurality of screws found below the end elongations 13 of the crosspiece 12, in such a way that when the crosspiece is extracted, or when the crosspiece is released, it will be retained and its own weight will cause it to rest on the screwed stops 19.

Finally, it may be pointed out that the frame 1 includes a plurality of fastenings 20 embedded beneath the ground in order to prevent any deformation to the frame when the lid 5 is tightened and secured by means of a screw 21 passing through a central opening 22 in the lid 5 in order to couple with a threaded hole 23 of a short vertical extension 24 integral with the crosspiece 12, which presents a profile essentially in form of a double "T" in orders to prevent deformations to it when the securing screw 21 is tightened.

The fastenings 20 are located at least in the opposite zones of the frame 1 where the end elongations 13 of the crosspiece 12 are secured, since when fitting the sealing lid 5 it is precisely in those opposite zones of the crosspiece 12 where the crosspiece 12 grips most.

What is claimed is:

1. A sealing device for a manhole, comprising:

a frame fixed in correspondence with an access mouth of a manhole;

a lid that rests on an internal rim of the frame with interposition of a sealing joint;

a crosspiece linked to the frame by means of a plurality of end elongations wherein a tightening screw that passes through a central opening in the lid is coupled for securing the lid against the sealing joint;

means for stably retaining the crosspiece;

characterised in that the sealing joint (6) comprises a perimetric upper plane (7) with an inclination descending inwards wherein a lower perimetric band (8) of the lid (5) presenting a same inclination rests in a complementary fashion, so as to achieve a progressive seal in line with the tightening of the lid (5) via a central screw (21).

2. A sealing device for a manhole, according to claim 1, characterised in that the crosspiece (12) is linked to the frame (1) via one end elongation (13) by means of an articulated coupling in a vertical axis (16) which links said end elongation (13) to a first upper piece (14) integral with the frame (1), there being a second upper piece (14) provided at a diametrically opposite point so as to enable to hinge the crosspiece (12) around said vertical axis (16).

3. A sealing device for a manhole, according to claim 1, characterised in that the crosspiece (12) is linked to the frame (1) via one end by means of an articulated coupling in a horizontal axis (15), there being an upper piece (14) provided at a diametrically opposite point so as to enable to hinge the crosspiece (12) around said horizontal axis (15).

4. A sealing device for a manhole, according to any of claims 1–3, characterised in that the end section of the crosspiece (12) opposite the articulated coupling with respect to the frame (1) comprises a conventional quick locking mechanism (17) which hooks to a bent extension (18) emerging from the upper piece (14) integral with the frame (1).

5. A sealing device for a manhole, according to claim 1, characterised in that the means for stably retaining the crosspiece (12) comprises a plurality of stops (19) secured to the frame (1) located below the end elongations (13) of the crosspiece (12).

6. A sealing device for a manhole, according to claim 1, characterised in that the frame (1) comprises a plurality of fastenings (20) embedded beneath the ground where the frame (1) is secured, said fastenings (20) being provided in at least two diametrically opposite points corresponding to the securing points for the crosspiece (12) to the frame (1).

7. A sealing device for a manhole, according to claim 1, characterised in that the sealing joint (6) comprises a lower flange (10) housed in a perimetric channel (9) located on an upper side of the internal rim (4) of the frame (1).

8. A sealing device for a manhole, according to claim 1, characterised in that the sealing joint (6) comprises a bent internal section (11) that clasps an inside edge of the internal rim (4) of the frame (1).

9. A sealing device for a manhole, according to claim 1, characterised in that the crosspiece (12) is a shape in form of a double "T".

10. A sealing device for a manhole, according to claim 1, characterised in that the crosspiece (12) is linked to the frame (1) via one end by means of an articulated coupling in a vertical axis, there being an upper piece (14) provided at a diametrically opposite point so as to enable to hinge the crosspiece (12) around said vertical axis.

* * * * *